US005345715A

United States Patent [19]

Kosikowski et al.

[11] Patent Number: 5,345,715

[45] Date of Patent: Sep. 13, 1994

[54] SERPENTINE STRUCTURE FOR A TURNSTILE

[75] Inventors: David M. Kosikowski, Brighton; John W. Kane, Dearborn, both of Mich.

[73] Assignee: Burle Technologies, Inc., Wilmington, Del.

[21] Appl. No.: 109,831

[22] Filed: Aug. 20, 1993

[51] Int. Cl.[5] ..... E05D 15/02

[52] U.S. Cl. ..... 49/42

[58] Field of Search ..... 49/42, 43, 46; D25/51

[56] References Cited

U.S. PATENT DOCUMENTS

| | | | |
|---|---|---|---|
| D. 188,191 | 6/1960 | Stevens et al. | D25/51 |
| 492,353 | 2/1893 | Gott | 49/46 |
| 985,544 | 2/1911 | Perey | 49/46 |
| 2,258,896 | 10/1941 | Kelker, Jr. | 49/42 |
| 2,309,893 | 2/1943 | Gersbach | 49/46 |
| 2,603,333 | 7/1952 | Richey | 49/46 |
| 3,019,539 | 2/1962 | Dolman | 49/46 |
| 3,839,825 | 10/1974 | Nica | 49/42 |
| 4,047,330 | 9/1977 | Gustafsson | 49/42 |
| 4,184,289 | 1/1980 | Lambertson | 49/42 |
| 4,472,909 | 9/1984 | Levy-Jospeh | 49/46 |
| 4,989,368 | 2/1991 | Trikilis | 49/42 |

FOREIGN PATENT DOCUMENTS

| | | | |
|---|---|---|---|
| 2736015 | 7/1978 | Fed. Rep. of Germany | 49/42 |

*Primary Examiner*—Philip C. Kannan
*Attorney, Agent, or Firm*—Martin Fruitman

[57] ABSTRACT

The invention is a turnstile gate with a serpentine configuration instead of conventional protruding arms. Both the stationary and revolving gates are formed of a continuous configuration of pipe which loops back and forth with substantial straight sections oriented horizontally. In order for the movable gate to pass through the stationary gate, the loops of the stationary gate must be offset from those of the revolving gate by one-half a cycle, and the loops of at least one of the gates must vary in their heights so that they can be located both outside and inside of the loops of the opposing gate. The advantages of the configuration are safety, ease of manufacture and greater strength, with a unique aesthetic appearance.

5 Claims, 1 Drawing Sheet

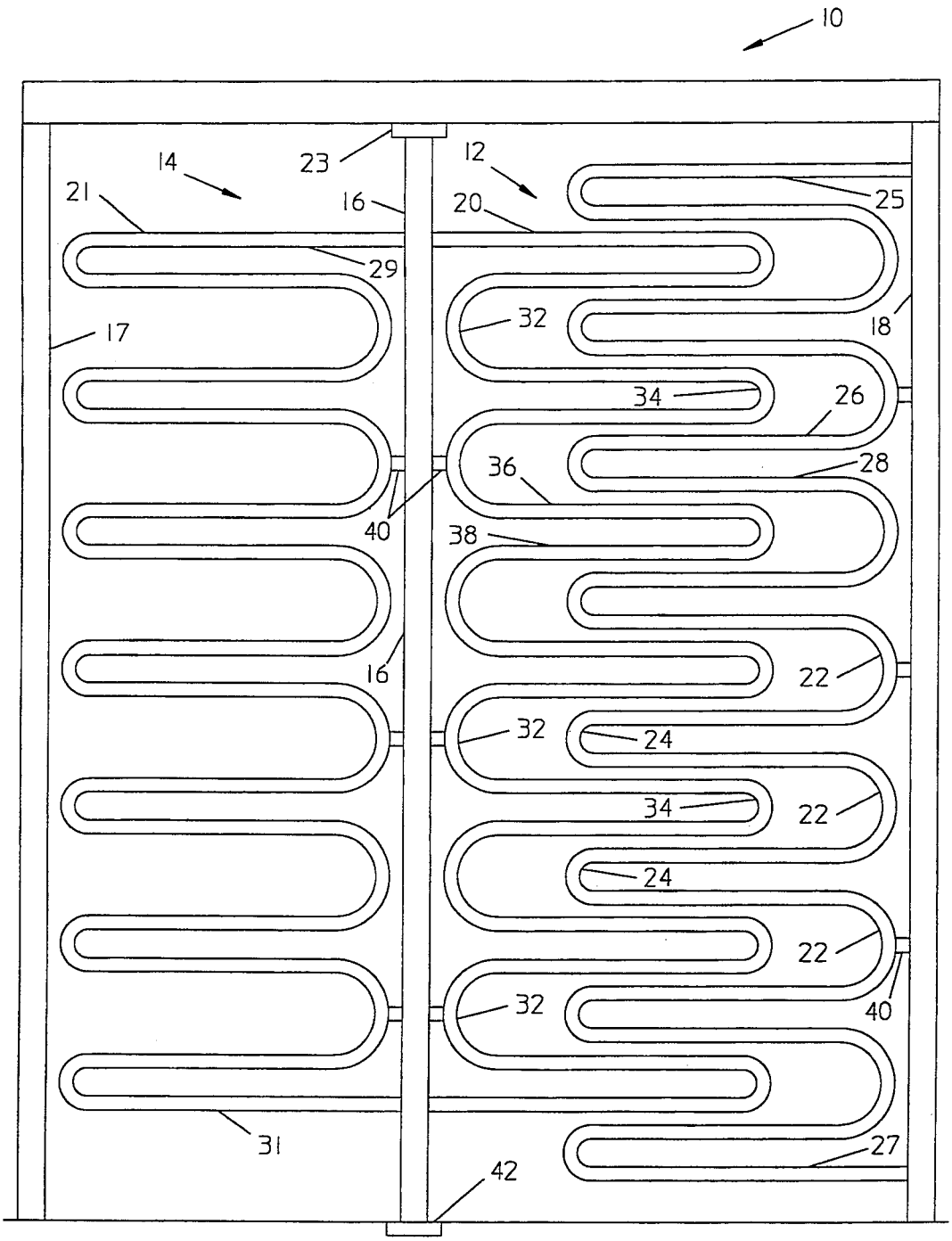
10
14
23
12
21
16
20
25
29
32
18
17
34
26
36
28
40
38
16
22
32
24
34
22
24
22
32
40
31
27
42

SERPENTINE STRUCTURE FOR A TURNSTILE

SUMMARY OF THE INVENTION

This invention deals generally with movable closures and more specifically with turnstiles which include plural wings rotating about a vertical axis.

Anyone who has ever used a subway or entered an amusement park has contacted a turnstile, and common experience suggests that there is very little variation in the structure of such devices, particularly those which are constructed to extend higher vertically than the people using them in order to prevent anyone jumping over the turnstile. Such typical turnstiles are installed in a fence or other barrier and are constructed with multiple horizontal bars extending from a vertical axis, with many such bars located one above another to form a virtual plane which can not be passed through, over or under. Several such configurations of bars form multiple wings which rotate around a common axis so that only one person can normally occupy the space between the wings, and, thus, passage through the turnstile with every partial rotation of the turnstile is limited to a single individual.

Each such turnstile also has a stationary section associated with it in order to prevent simply walking around the ends of the protruding bars. Also, to prevent "squeezing" past the ends of the bars, most such stationary sections of turnstiles overlap the rotating sections and are also constructed of protruding bars offset from the rotating bars so that the two sets pass between each other. With that type of construction it is possible to overlap the stationary and rotating sections to whatever extent is necessary to prevent bypassing the turnstile.

The present invention has a unique and aesthetically pleasing structure to replace the horizontal bars of the conventional turnstile. Instead of individual bars, the rotating and stationary sections of the turnstile are each constructed of a single assembly of pipe shaped into a serpentine configuration, with multiple loops, significant segments of which are oriented horizontally and parallel to each other. The overall appearance of the turnstile is somewhat similar to a group of paper clips stacked one above the other, but the benefits derived from the structure are unique.

First, there are no exposed ends of pipes or rods. Therefore, there is no problem with snagging clothing. Each exposed end of both the stationary and rotating sections is a simple rounded loop joining two horizontal bars.

Second, construction is simple and inexpensive. The multiple loop structures can be constructed either as a single length of tubing with repeated reverse bends, or they can be assembled from previously constructed half loops of standard size. With either construction method, the end result is a unitized serpentine structure in which each loop aids in the support of the adjacent loops. It is therefore possible, with proper selection of materials and sizes, to attach the unitized serpentine loop structures to the vertical supports at only the tops and bottoms of the multiple loop assemblies. However, even with thin or somewhat flexible tubing it is not necessary to attach every loop to the vertical support. Assembly is therefore much simpler than for a conventional turnstile, because a single attachment to the vertical support at, for instance, every other loop substitutes for four individual attachments in a conventional turnstile with horizontal bars.

Finally, the present invention furnishes a distinctive and attractive appearance. The conventional horizontal bar turnstile brings to the mind of the user visions of jail bars and imprisonment, which is never a pleasant association. The present invention brings forth no such images. It is instead reminiscent of gentle and flowing lines similar to, for instance, ocean waves.

One subtlety of the serpentine turnstile design is that at least either the stationary or rotating sections must be constructed with loops of at least two pitches. Because the wings of the rotating section must overlap and still pass through the stationary section, at least one section must be built so that, for adjacent loops, one loop fits within the loops of the opposing section, and the adjacent loop fits outside the loops of the opposing section. If the two sections were both made of regular pitch loops, they could not overlap and still pass through each other. In the preferred embodiment, the loops are all made of identical serpentine configurations, but alternate loops of both sections are of different pitch, and, of course, the loops of opposing sections are offset from each other by the spacing of one loop.

The serpentine turnstile structure of the present invention therefore furnishes a highly stable and attractive turnstile which is simple and inexpensive to construct.

BRIEF DESCRIPTION OF THE DRAWING

The FIGURE is a simplified schematic diagram of the serpentine turnstile of the preferred embodiment.

DETAILED DESCRIPTION OF THE INVENTION

The FIGURE is a simplified schematic diagram of the preferred embodiment of serpentine turnstile 10 which includes stationary section 12, rotating section 14 and vertical members 16, 17 and 18. Rotating section 14 typically includes several identical wings, usually protruding from axis 16 at 90 or 120 degree intervals, which are attached to and rotate around vertical axis 16, but for clarity only two of the identical wings, 20 and 21, are shown.

Axis 16 rotates on bearings 23 and 42 so that wings 20, 21 and the several other wings attached to axis 16 each, in turn, pass through stationary section 12. As with all turnstiles, the typical dimensions of rotating section 14 are chosen so that normally only one individual user can occupy the space between wings, and, as the wing in front of the user passes vertical member 17, the user can proceed beyond turnstile 10. The FIGURE pictures wing 20 as it is just passing through stationary section 12 and wing 21 as it is just passing vertical member 17.

The preferred embodiment of the present invention pictured in the FIGURE differs from conventional turnstiles in that both stationary section 12 and rotating wings 20 and 21 are constructed in serpentine configuration, rather than of individual parallel bars.

Stationary section 12 is built with multiple loops, of which loops 22 near vertical support 18 and protruding loops 24 are typical, formed into a continuous serpentine structure. The loops each have substantial segments, of which bars 26 and 28 are typical, which are parallel and horizontal, so that the horizontal segments function as restrictions for passage of the user through stationary section 12. Top horizontal segment 25 and bottom horizontal segment 27 are each extended slightly to reach vertical member 18 to which they are attached, typically by welding.

Similarly, wings 20, 21 and the other wings (not shown) of rotating section 14 are also built with multiple loops, of which loops 32 near axis 16 and protruding loops 34 are typical. These loops are also formed into a continuous serpentine structure. These loops also each have substantial segments, of which bars 36 and 38 are typical, which are parallel and horizontal. These horizontal segments function as restrictions for passage of the user through wings 20 and 21, thus necessitating the user to push wing 21 past vertical member 17 for access beyond turnstile 10. As wing 21 is passing vertical member 17, wing 20 is passing through stationary section 12.

Top horizontal segment 29 and bottom horizontal segment 31 of wing 21 are each extended slightly to reach axis 16 to which they are attached, typically by welding. The other wings are attached to axis 16 in a similar manner.

Clearly, in order to prevent a user from squeezing around wing 20 or stationary section 12, it is necessary for wing 20 to overlap stationary section 12. Furthermore, in order for the overlapping loops such as protruding loops 34 of wing 20 to pass through between protruding loops 24 of stationary section 12, the inside dimensions of loops 22 of stationary section 12 nearest vertical support 18 must be larger than the outside dimensions of protruding loops 34 of wing 20. A similar relationship must also exist between the protruding loops 24 of stationary section 12 and loops 32 of wing 20 which are nearest to vertical axis 16.

This geometry requires that at least stationary section 12 or wing 20 have a loop structure with at least two different pitches, but for ease of manufacture, the structure of the preferred embodiment is desirable, with both wing 20 and stationary section 12 having the same two different pitches. With the preferred embodiment structure pictured, it is possible to manufacture long lengths of serpentine assemblies with alternating smaller and larger pitch loops, and merely cut off the number of loops required for any installation. As clearly seen in the FIGURE, such identical serpentine sections are then installed opposite each other and offset by one loop in order to permit the wings to pass through the stationary section.

An optional part of serpentine turnstile 10 is also pictured in the FIGURE. In some circumstances, additional structural support may be desirable for wing 20 or stationary section 12. This can easily be furnished by struts 40 which attach loops 22 of stationary section 12 to vertical support 18 or loops 32 of wings 20 and 21 to axis 16. Struts 40 can easily be attached by welding or other conventional methods in the same manner which the top and bottom horizontal sections of the serpentine structures are attached to vertical supports 17 and 18 and axis 16.

The present invention therefore furnishes a strong, safe, and easily assembled turnstile which is also attractive.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, it is possible to construct either the movable wings or the stationary section with a single repeating pitch for its loops, in which case the other section must have sufficient difference in its two loop pitches to alternately fit inside and outside the single repeating pitch.

What is claimed as new and for which Letters patent of the United States are desired to be secured is:

1. In a turnstile of the type which includes a stationary section which defines a plane and a movable section, with the movable section comprised of at least one wing which also defines a plane, with the plane of each wing of the movable section overlapping the plane of the stationary section when each wing approaches the stationary section, with both the stationary section and the wings of the movable section comprising several horizontal structures with spaces between the horizontal structures, and with the horizontal structures of each wing located so that they pass through the spaces of the stationary section as the wing is moved past the stationary section, the improvement comprising:

the horizontal structures of the stationary section and the horizontal structures of each wing of the movable section comprising loops formed with horizontal segments and curved sections joining horizontal segments which are vertically displaced from each other.

2. The turnstile of claim 1 wherein the loops of the stationary section form a continuous serpentine structure, and the loops of at least one section are constructed with loops of at least two different pitches.

3. The turnstile of claim 1 wherein the loops of the wings of the movable section form continuous serpentine structures, and the loops of at least one section are constructed with loops of at least two different pitches.

4. The turnstile of claim 1 wherein the loops of the stationary section and the loops of the wings of the movable section are made of identical serpentine configurations, with adjacent loops of both sections of different pitch, and the loops of the moving section are offset from the loops of the stationary section by the spacing of one loop.

5. The turnstile of claim 1 further including at least one support strut connecting a loop to a support structure.

* * * * *